United States Patent [19]

Leahy

[11] Patent Number: 4,608,123

[45] Date of Patent: Aug. 26, 1986

[54] METHOD OF MINIMIZING UNTOWARD EFFECT OF CONTAMINANTS, SUCH AS PITCH, IN THE PAPERMAKING OPERATION

[75] Inventor: Robert J. Leahy, New Castle County, Del.

[73] Assignee: Hercules Incorporated, Wilmington, Del.

[21] Appl. No.: 703,578

[22] Filed: Feb. 20, 1985

[51] Int. Cl.[4] ..... D21H 5/12

[52] U.S. Cl. ..... 162/146; 162/199; 162/DIG. 4

[58] Field of Search ..... 162/72, 146, 157.5, 162/199, 189, DIG. 4

[56] References Cited

U.S. PATENT DOCUMENTS

| | | | |
|---|---|---|---|
| 3,147,216 | 9/1964 | Oemler | 210/40 |
| 3,992,249 | 11/1976 | Farley | 162/72 |
| 4,154,646 | 5/1979 | Rave | 162/146 |
| 4,196,305 | 4/1980 | Murphy et al. | 568/758 |
| 4,276,179 | 6/1981 | Soehngen | 210/679 |

FOREIGN PATENT DOCUMENTS

| | | |
|---|---|---|
| 47-17403 | 5/1972 | Japan . |
| 48-06402 | 2/1973 | Japan . |

*Primary Examiner*—Peter Chin

[57] ABSTRACT

Disclosed is a method of minimizing the untoward effect of contaminants, such as pitch and related materials, in the papermaking operation. An aqueous dispersion of water-dispersible synthetic pulp, such as polypolyolefin pulp, is added to a pulp slurry comprised of cellulosic pulp, at a point prior to sheet formation. The synthetic pulp adsorbs a substantial amount of the pitch present in the pump slurry and prevents it from depositing on the papermaking apparatus.

3 Claims, No Drawings

METHOD OF MINIMIZING UNTOWARD EFFECT OF CONTAMINANTS, SUCH AS PITCH, IN THE PAPERMAKING OPERATION

This invention relates to the papermaking art. Particularly it relates to a method of minimizing the untoward effects of contaminants, such as pitch, in the papermaking operation.

A major problem in paper manufacture is the coagulation of resinous materials and gums, referred to in the art as "pitch", on the beater and paper machine parts. Pitch is liberated from the pulp during the beating and refining process and tends to accumulate as a colloidal suspension of particles. These particles fill in the wire, thereby producing holes in the finished paper. Also these particles collect on the felts and machine parts as sticky, usually dark-colored lumps. The pitch comes mostly from the resinous matter in the virgin pulps themselves. Once pitch becomes attached to the parts of a paper machine, the only way it can be removed is by scrubbing with solvents such as xylene, kerosene, mineral spirits and the like.

In addition to virgin pulps there also are many types of recycled pulps that also lead to pitch problems. Some of these are due to resinous materials being further extracted by the additional processing. Some are due to deinking operations. Others are the products of coating and printing that occurred in the paper's previous use. Sometimes a white pitch associated with a coating binder is observed.

The common denominator is that a non-cellulose material deposits on papermaking apparatus to detract from either production or quality or both.

There are two ways of combating pitch beside cleaning the pulp by chemical and mechanical treatments. One is to adsorb or precipitate the pitch to render it harmless and the second is to disperse the pitch to prevent it from depositing. In either case it is obvious that we are dealing with a colloidal phenomenon. The traditional adsorbent is talc, the traditional precipitant is alum, and surfactants in many combinations are used as dispersants.

Pitch is only a problem when it comes out of the water phase. Water-soluble materials present in the aqueous phase do not lead to spots, picking or deposits. Water-insoluble materials that are large enough to settle or be screened are usually removed in the pulp cleaning operations. The difficulty arises from the colloidal material which is temporararily in the water phase. This colloidal material can rapidly adsorb on surfaces and there agglomerate to larger particles and cause problems.

In accordance with this invention, there is provided an improved method of manufacturing paper from an aqueous dispersion of cellulosic pulp containing contaminants, such as pitch, wherein there is incorporated in the cellulosic pulp, prior to sheet formation, a material to reduce the untoward effects of the contaminant on the papermaking operation. The improved method of this invention comprises adding to the cellulosic pulp, prior to sheet formation, a water-dispersible synthetic pulp, preferably a polyolefin pulp such as polyethylene pulp and polypropylene pulp.

Synthetic pulp is well known in the art as are methods of manufacturing same. See, for example Kirk-Othmer, "Pulp, Synthetic," *Encyclopedia of Chemical Technology*, 3d Ed., Vol. 19, pp. 420–435. The disclosures of this article are incorporated herein by reference.

Water-dispersible polyolefin pulp is well known in the art and is available commercially. Once prepared by conventional means, polyolefin pulp can be made water dispersible by dispersing it in an aquous solution containing a dispersing agent. The dispersing agent may be cationic, anionic, or nonionic.

Typical of applicable cationic dispersing agents are those formed by the copolymerization of from about 60% to about 85% by weight of an acrylamide having the formula:

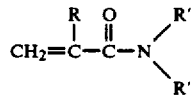

with from about 15% to about 40% by weight of an acrylate or methacrylate ester having the formula:

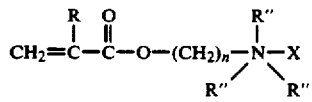

The amount of each monomer is based on the total monomers charged. In the formulas, R is hydrogen or methyl. R′ is hydrogen, methyl or ethyl; R″ is methyl or ethyl, and, at least one R″ being methyl when X is the methyl sulfate anion. Alternatively, X can be the chloride anion and n is 1 to 4. When using these copolymers as dispersing agents, the pH of the aqueous solution thereof is adjusted to be in the range of from about 9.5 to about 12 either prior to, during or after contact of the polyolefin pulps with said solution.

A specific cationic dispersing agent is a cationic copolymer of acrylamide and a methacrylate ester; more specifically, it is a copolymer of acrylamide and methacryloyloxyethyltrimethylammonium methyl sulfate (MTMMS). The amount of acrylamide in this particular copolymer is 66% by weight, and the amount of MTMMS is 34% by weight.

Other operable cationic dispersing agents include the tetraalkylammonium halides such as dodecyltrimethylammonium chloride or bromide; tetradecyltrimethylammonium chloride; hexadecyltriethylammonium iodide and octadecyltri-n-butyl ammonium chloride.

Representative anionic dispersing agents are (1) the alkyl aryl sulfonates such as sodium p-dodecylbenzene sulfonate; sodium isopropylnaphthalene sulfonate; sodium tetrahydronaphthalene sulfonate; sodium methylnaphthalene sulfonate; and (2) the alkyl sulfates such as sodium cetyl sulfate; ammonium lauryl sulfate; and sodium tridecyl sulfate.

Exemplary nonionic dispersing agents are the polyvinyl alcohols as well as the aryloxypoly(ethyleneoxy) alkanols, such as phenoxypenta(ethyleneoxy)ethanol, phenoxyocta(ethyleneoxy)ethanol, phenoxydeca(ethyleneoxy)ethanol, 4-methylphenoxypenta(ethleneoxy)ethanol, and 2,3,6-triethylphenoxyhepta(ethyleneoxy)ethanol. Related compounds containing both ethyleneoxy and propyleneoxy groups are also useful nonionic dispersing agents. All of the aforementioned dispersing agents are used in the amounts ordinarily required to provide an effective dispersion of pulps in an aqueous medium.

Other methods of dispersion such as oxidation or ozonolysis of the spurted polyolefin pulp or addition of alkali treated water-soluble polymers containing quaternary ammonium groups are known to those skilled in the art.

Once water dispersible spurted polyolefin pulp is obtained it is added to water and agitated to form an aqueous dispersion. Only a small amount, preferably less than about 3% by weight, is added to the water.

In Examples 1 and 2 below cellulosic pulp is formed into sheets on a papermaking machine. The cellulosic pulp is in the form of a slurry containing about 3% by weight of pulp on a dry basis. The cellulosic pulp contains deinked pulp from coated publication grade paper, pulp from kraft paper clippings or trim, and pulp from mixed whites.

EXAMPLE 1

The papermaking machine is run for four days. No material is added to the pulp to adsorb, precipitate, or disperse the pitch. During the first day of machine operation the machine is shut down to remove pitch from the wire and the amount of solvent (mineral spirits) used to remove the pitch is about 490 gallons.

During the second day of operation, the machine is shut down to remove pitch from the wire and the amount of mineral spirits used to remove the pitch is about 690 gallons.

During the third day of operation, the machine is shut down to remove pitch from the wire and the amount of mineral spirits used to remove the pitch is about 410 gallons.

During the fourth day of operation, the machine is shut down to remove pitch from the wire and the amount of mineral spirits used to remove the pitch is about 490 gallons.

EXAMPLE 2

On the fifth, sixth, seventh and eighth days of operation of the papermaking machine there is added to the blend chest prior to sheet formation polypropylene pulp that is rendered water-dispersible by treatment with polyvinyl alcohol. The water-dispersible pulp is added as an aqueous dispersion containing about 0.15% by weight of the polypropylene pulp. The amount of the aqueous dispersion that is added to the blend chest is sufficient to provide 0.25% by weight (dry basis) of polypropylene pulp based on the weight of the cellulosic pulp (dry basis) in the blend chest.

During the fifth day the machine is shut down to remove the pitch from the wire and the amount of solvent (mineral spirits) used to remove the pitch is about 110 gallons.

During the sixth day the machine is shut down to remove the pitch from the wire and the amount of mineral spirits used to remove the pitch is about 320 gallons.

During the seventh day the machine is shut down to remove the pitch from the wire and the amount of mineral spirits used to remove the pitch is about 210 gallons.

During the eighth day the machine is shut down to remove the pitch from the wire and the amount of mineral spirits used to remove the pitch is about 270 gallons.

A summary of Examples 1 and 2 is set forth below in Table I.

TABLE I

| | Solvent Usage - Gallons |
|---|---|
| Example 1 | |
| Day 1 | 490 |
| Day 2 | 690 |
| Day 3 | 410 |
| Day 4 | 490 |
| Average | 520 |
| Example 2 | |
| Day 5 | 110 |
| Day 6 | 320 |
| Day 7 | 210 |
| Day 8 | 270 |
| Average | 227.5 |

EXAMPLE 3

In a paper mill manufacturing paper pulp from deinked pulp and waste paper, water-dispersible polypropylene pulp (as used in Example 2) in an aqueous dispersion is added to the blend chest of the papermaking machine in an amount of 0.15% by weight (dry basis) of the weight of the cellulosic pulp. For a 60-day trial period using the polyolefin pulp the solvent used to remove pitch from the paper machine wire averaged 703 gallons per day. For the four-month period prior to this 60-day trial, the mill's use of solvent for pitch removal averaged 2,432 gallons per day.

The amount of synthetic pulp used in carrying out this invention is within the skill of those versed in the papermaking art. The amount of synthetic pulp will be by weight (dry basis) from about 0.05% to about 0.25% based on the dry weight of the cellulosic pulp, and preferably from about 0.1% to about 0.2%.

Polyolefin pulp is the preferred synthetic pulp. Of the polyolefin pulps, polyethylene pulp and polypropylene pulp are preferred.

It is to be understood that the above description is illustrative of the invention and not in limitation thereof.

What I claim and desire to protect by Letters Patent is:

1. In the method of manufacturing paper from an aqueous dispersion of cellulosic pulp containing pitch and wherein there is incorporated in the cellulosic pulp, prior to sheet formation, a material to reduce the untoward effects of the pitch on the papermaking operation, the improvement which comprises adding to the cellulosic pulp, prior to sheet formation, a water-dispersible polyolefin pulp, the amount of polyolefin pulp employed being by weight (dry basis) from about 0.05% to about 0.25% based on the dry weight of the cellulosic pulp.

2. The method of claim 1 wherein the polyolefin pulp is polyethylene pulp.

3. The method of claim 1 wherein the polyolefin pulp is polypropylene pulp.

* * * * *

UNITED STATES PATENT AND TRADEMARK OFFICE

CERTIFICATE OF CORRECTION

PATENT NO. : 4,608,123

DATED : August 26, 1986

INVENTOR(S) : Robert J. Leahy

It is certified that error appears in the above-identified patent and that said Letters Patent is hereby corrected as shown below:

Column 2, second formula:

should read:

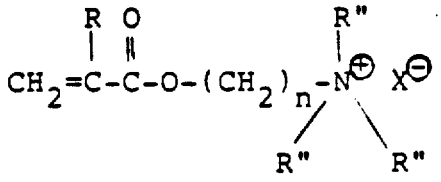

instead of

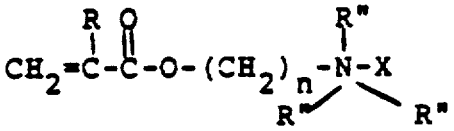

Signed and Sealed this

Twenty-first Day of June, 1988

*Attest:*

DONALD J. QUIGG

*Attesting Officer*

*Commissioner of Patents and Trademarks*